United States Patent [19]

Frye et al.

[11] Patent Number: 4,541,585

[45] Date of Patent: Sep. 17, 1985

[54] COMPLIANT DRUM AND RIDER ROLL

[75] Inventors: Kenneth G. Frye, South Egremont, Mass.; Michael L. Gill, Beloit, Wis.

[73] Assignee: Beloit Corporation, Beloit, Wis.

[21] Appl. No.: 529,512

[22] Filed: Sep. 6, 1983

[51] Int. Cl.[4] ..... B65H 17/08

[52] U.S. Cl. ..... 242/66; 242/72 B

[58] Field of Search ..... 242/65, 66, 67.2, 18 DD, 242/72 B; 226/190, 191, 193; 100/163 R, 163 A, 164, 169

[56] References Cited

U.S. PATENT DOCUMENTS

| | | | |
|---|---|---|---|
| 3,224,698 | 12/1965 | Conti | 242/55 |
| 3,237,877 | 3/1966 | Printz et al. | 242/66 |
| 3,240,442 | 3/1966 | Kilmartin | 242/66 |
| 3,458,150 | 7/1969 | Cowan | 242/72 B |
| 3,834,257 | 9/1974 | Ganser | 242/72 B |
| 4,181,270 | 1/1980 | Laar et al. | 242/66 |

*Primary Examiner*—Leonard D. Christian

*Attorney, Agent, or Firm*—Hill, Van Santen, Steadman & Simpson

[57] ABSTRACT

A winder for continuously winding a traveling web such as paper onto a large roll with a support roll in contact with the roll being wound such as where the support roll is one or both of a pair of parallel horizontally extending drums with the outer surface of the drum being of rubber with embedded nonextensible annular cords and the surface being supported by a plurality of inflatable chambers along the length of the drum so that the outer surface of the drum deforms with contact with the roll being wound and accommodates irregularities along the length of the roll being wound.

25 Claims, 4 Drawing Figures

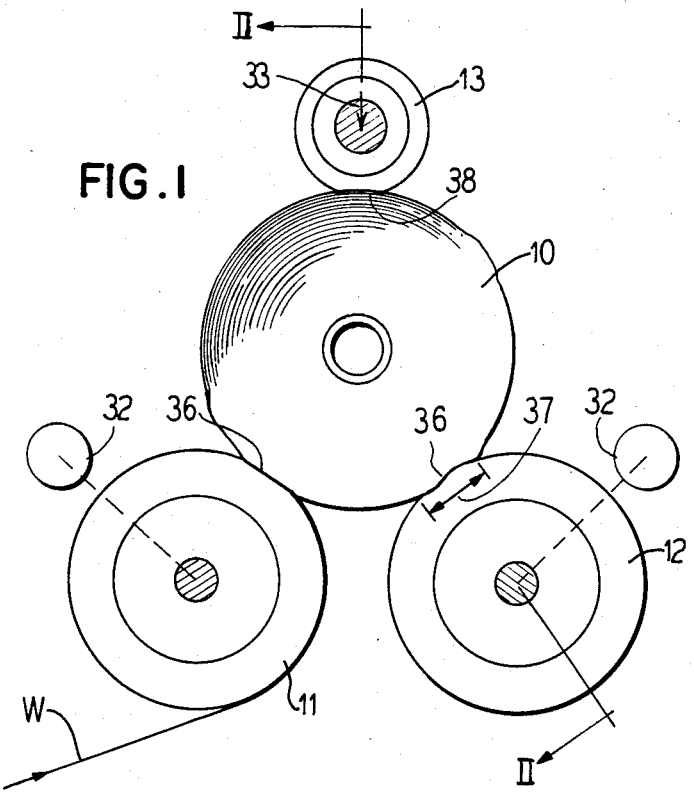
FIG. 1
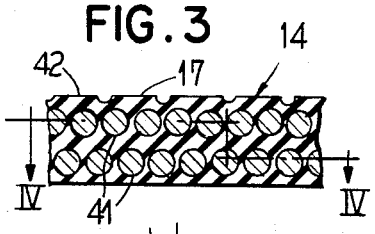
FIG. 3
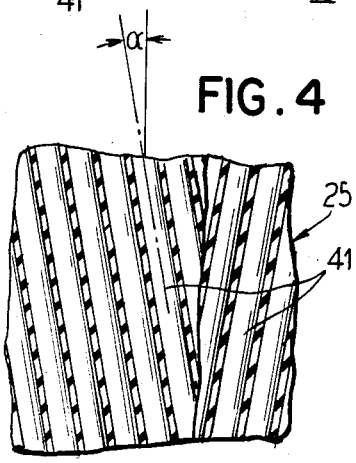
FIG. 4
FIG. 2
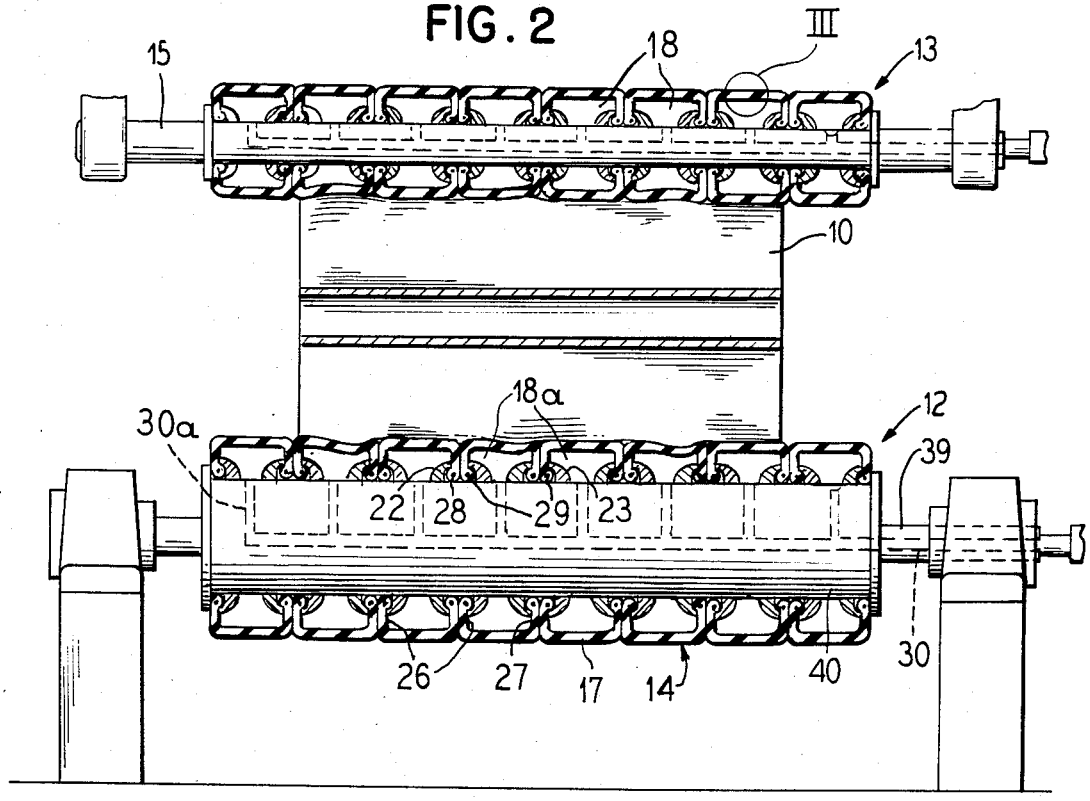

COMPLIANT DRUM AND RIDER ROLL

BACKGROUND OF THE INVENTION

The present invention relates to improvements in winders of the type for winding a traveling web onto a roll.

One commonly utilized form of winder in the paper industry has been the two drum winder which has long been the workhorse of the paper industry. A two drum winder employs two parallel horizontal side-by-side drums with at least one driven in rotation to support and rotate a large roll being wound from a traveling supply web. An important factor in the performance in the two drum winder is the force or pressure between the winding drums and the roll being wound inasmuch as the tension of the web on the roll is a function of the nip pressure between the roll and the drums. Control of this factor has been obtained by using a rider roll which applies a downward force at the start of winding of the wound roll to increase the nip pressure between the drums and the roll being wound.

A significant problem resides in a two drum winder due to the fact that the caliper and basis weight profile varies along the length of a roll of paper being wound. This will generate irregularities along the roll length, and the roll is usually only supported at the high profile points by the drum. With the drums supporting the roll at the high points, the whole weight of the roll is supported at these locations thus creating high nip pressures and consequently high wound-in tensions, the degree of which depend on the width of the high points. One method of coping with this problem has been to oscillate the high points by oscillating the unwind stand making the high points wider.

It is accordingly an object of the present invention to provide improvements in winder structures and methods used for winding so that an improved quality of roll results and that the problems caused by high points in a roll being wound are substantially minimized, and the necessity for attempting to broaden the high points or otherwise control them is obviated.

A more broad object of the invention is to provide a drum or roll for effecting pressure contact with a roll being wound with a traveling web wherein the drum contacts the wound roll in area contact rather than point contact and wherein substantially uniform contact pressure is obtained between the drum and roll being wound over the length of the drum and high points on the wound roll do not adversely affect the contact pressure which remains distributed.

A further object of the invention is to provide an improved support roll construction for use in a two drum winder wherein the support roll conforms to irregularities along the length of the roll being wound and wherein a relatively broad surface contact is obtained at the nip between the drum and roll being wound.

A still further object of the invention is to provide a two drum winder with an improved deformable outer surface so as to provide surface area contact between the drum and roll being wound wherein the area of the nip widens at the weight of the roll increases and wherein the drum is particularly durable with a long operating life and has a constant circumferential length despite deformation at the nip.

A feature of the invention is to provide a support roll or drum for a winder such as where the drums in a two drum winder have a surface which comprises an inflatable sleeve reinforced so that the circumference is fixed and the profile straight. The drums are constructed with a resilient deformable outer surface so that the surface of the winder drum in its contact with the roll being wound deforms as tires on a car deform around a pebble while still providing uniform support for the car. The supporting drum includes an outer support surface layer formed of a deformable material surrounding an inflatable air chamber. In a preferred form, the air chamber is divided into individual chambers along the length of the supporting drum. The individual air chambers deform to match the profile of the paper surface along the roll being wound, thus creating more support for the whole weight of the roll and with more support, the pounds per square inch nip pressures become lower thus causing lower wound-in tensions. Also, as the weight of the roll builds up, the deformation of the air chamber will cause wider support or wider nip width thus automatically equalizing the pressure in the nip between the drum and the rolls. By controlling the pressures within the air chamber as a function of paper grade or desired results, different nip widths and softer or more controlled winding can be attained.

The deformable outer layer of the inflatable chamber preferably is of a material such as rubber with embedded nonextensible cords extending circumferentially such as at a small angle to the rotation of the drum surface. This maintains a constant circumference of the drum and provides a drum which is capable of transmitting torque to drive the roll in rotation. The embedded cords are high modulus cords which extend at a very low angle with respect to the circumferential direction. Very little rubber is provided on the outside surface to avoid flow. If a pattern is required for venting, very high modulus rubber is used. It is possible to use several such sleeves across the length of the drum, and the sleeves will have properties to conform to the varying profile of the roll of paper.

Other objects, advantages and features, as well as equivalent structures which are intended to be covered herein, will become more apparent with the teaching of the principles of the invention in connection with the disclosure of the preferred embodiments in the specification, claims and drawings, in which:

DESCRIPTION OF THE DRAWINGS

FIG. 1 is a schematic end elevational view of a two drum winder constructed and operating in accordance with the principles of the present invention;

FIG. 2 is a somewhat schematic vertical sectional view taken substantially along line II—II of FIG. 1;

FIG. 3 is an enlarged fragmentary view taken in the circled location III of FIG. 2; and FIG. 4 is a schematic sectional view taken substantially along line IV—IV of FIG. 3.

DESCRIPTION OF THE PREFERRED EMBODIMENT

FIGS. 1 and 2 illustrate a two drum winder wherein a roll 10 is being wound from a traveling web W supplied continuously to the roll. The roll is wrapped on a starting core, and is wound in a winding nest where it is supported on drums 11 and 12. A rider roll 13 is pressed down on top of the winding roll 10 with a predetermined force to increase the nip pressure between the roll 10 and its supporting drums 11 and 12 as the roll is started. When the weight of the roll reaches a predetermined amount, the nip pressure is sufficient due to the increasing weight of the wound roll 10. Inasmuch as the wound up tension of the roll is a function of the nip pressure between the roll and its supporting drums, this wound up tension is controlled by controlling the force applied by the rider roll, as indicated schematically by the arrowed line 33.

The roll is driven in rotation such as by applying a driving force to the drums with the drives being shown schematically at 32. The web W to be wound is fed over the surface of the drum 11 and onto the roll 10 being wound.

In accordance with the invention, the support rolls and drums which are the rolls and drums in supporting contact with the roll being wound include one or more inflatable sleeves or torroidal membrane 14 having a compliant outer surface so that the wound up roll is engaged by area contact rather than straightline contact which would be the case if a hard rider roll and hard winder drums were used with polished steel outer surfaces or with hard covered outer surfaces.

The sleeve or membrane 14 is suitably reinforced so as to be substantially inextensible in the circumferential directions when inflated. This effectively resists flow or movement of the rubber in circumferential or axial directions as the sleeve passes through the contact area. Such a flow or movement would occur if, for example, a roll were provided with a soft outer covering to provide an area contact in the nip. The solid rubber cover which is incompressible will nevertheless be deflected as it passes through the nip to form a wide contact area. This deflection results in flow or movement of the rubber in axial or circumferential directions. Such movement or flow of the rubber cannot be tolerated in a winding operation.

The surface areas of contact are shown in FIG. 1 at 36 and 37 between the drums 11 and 12 and at 38 between the roll and the rider roll 13. The nip width 37 depends on the force between the supporting drums and the roll and the inflation pressure in the sleeve 14. The nip width will increase with increase of weight of the roll 10 thus maintaining a somewhat constant unit pressure between the roll and supporting drums which was not the case when polished iron winder drums were used. An important feature afforded by utilizing a rider roll and one or more drums with compliant outer surfaces is that the surface conforms to irregularities along the length of the roll 10 being wound. In papermaking, the web does not have perfect uniform basis weight across its width, and the variance in paper profile will cause a buildup at high points on the wound roll 10. With a hard surfaced winder drum and hard surfaced rider roll, contact would occur only at the high points creating undesirable pressure points at these locations. With the present arrangement with the compliant outer surface, on the drums and on the rider roll supporting contact is continuous along the length of the wound roll and not only is contact continuous, but essentially supporting pressure is continuous so that no adverse effects occur due to pressure points occurring at the high points along the length of the wound roll 10.

the compliant surface is attained by a drum structure including an inflatable torroidal sleeve or membrane having a circumferential outer surface layer of a deformable flexible material such as rubber. A relatively thin layer is preferred of sufficient strength for the drums to withstand the torque of the driving forces and withstand the fluid pressure within the fluid chamber enclosed and supporting the surface layer. The surface layer is annular in shape, and annular inner supporting chambers 18 for the rider roll and **18*a* for the drum are provided. The supporting chamber may be continuous along the length but preferably is divided into separate compartments. The fluid chamber can be provided as an air chamber which is inflatable with air through an air pressure line. Air is supplied to the air chamber for the drums through air supply lines 30 extending through the shaft 39 for each drum. The center of the drum may have an enlarged core 40 for supporting the individual air compartments, and air lines 30*a*** may connect to the individual compartments.

While air is preferred for an inflation medium, other types of fluid may be employed, and the supporting chamber may be filled with water in certain constructions. Where small supporting rolls are used, water may be satisfactory, although in larger rolls the weight of the water may cause excessive centrifugal forces. Instead of a deep chamber, a shallow outer chamber or bladder may be provided which will reduce the volume and weight of the fluid necessary to fill the chamber.

The principles involved in the inflatable sleeve or membrane 14 will be the same for both the support drums 11 and 12, and the rider roll 13 and a description of one, therefore, shall suffice for all. In particular and with reference to the drum 12 illustrated in FIG. 2, the inflatable sleeve or membrane 14 includes a circumferentially extending outer surface layer 17 which in the particular embodiment illustrated is seqmented into several portions along the axial length of the drum 12. Each portion of the outer surface layer 17 includes a pair of radially inwardy extending sidewall portions 26 and 27 which terminate at their radially inner ends in a pair of circumferentially extending inextensible bead portions 28 and 29. The inextensible bead portions 28 and 29 are clamped to the core 40 by suitable clamps 22 and 23 which secure the beads 28 and 29 in their respective axial position and effectively resist rotation of the beads about the drum 40. the specific mounting and clamping means will depend upon the drum core 40, but in any event could be similar to one of the many clamping devices heretofore utilized in the pneumatic tire art.

The sleeve or membrane 14 is suitably reinforced so as to provide a predetermined inflated size and shape. In a preferred embodiment, substantially inextensible cords extend from one bead core 28 through the sidewall 26 across the outer surface layer 17, and through the opposite sidewall 27 to the opposite bead core 29. This layer of cord reinforcement structure can comprise one ply of radially extending cords or multiple plies which could include cords extending at an acute angle with respect to the radial directions.

More particularly, and with respect to the outer surface layer 17, there is provided a circumferentially extending cord reinforcing structure 25 which is substantially inextensible in circumferential directions. This cord reinforcing structure 25 may include one or more layers of substantially circumferentially extending cords or cords extending at a zero degree angle with respect to the circumferential direction. Alternatively, this cord reinforcing structure, as illustrated in FIGS. 3 and 4, may include a plurality of plies of cords extending at a small angle $\alpha$ with respect to circumferential directions. This small angle $\alpha$ should be in the range of from 10 degrees to 30 degrees with the cords in adjacent layers extending at opposite angles with respect to the circumferential direction. These cords must be of sufficiently high modulus and placed sufficiently close to each other so as to prevent shifting or movement of the cords and thereby effectively resist circumferential elongation of the outer surface layer 17.

Although in the particular embodiment illustrated, a unitary outer sleeve member 14 is provided it will be appreciated that a plurality of individual chambers or torroidal members could be provided in side-by-side relationship to effectively provide a composite sleeve or membrane 14. Further, although the bead members 28 and 29 have been described as being inextensible in circumferential directions, it will be appreciated that if the clamping means 22 and 23 are adequate to secure the radially inner beads in position they need not in themselves be inextensible.

In accordance with the method of the invention, air is inflated into the inflatable support chambers at a pressure which will obtain the desired area of contact between the drums or rider roll and the roll. For example, if the inflation pressure is increased, the width of the nip, shown at 35 in FIG. 1, will decrease, and if the inflation pressure is decreased, the nip width 35 will increase. For different weights of paper and different grades of paper, different nip widths will be found to be desirable, and the nip width can be controlled by the inflation pressure or can be kept constant.

As illustrated in FIGS. 3 and 4, the outer surface layer of material is preferably of rubber or other compounded material which is flexible and capable of withstanding surface friction wear. Embedded in the rubber are high modulus cords which may extend circumferentially with respect to the sleeve. Alternatively, as illustrated in FIG. 4, the cords may extend at an angle $\alpha$ relative to the circumferential direction of drum rotation, which is preferably in the range of 10° to 30°. Cords in the alternate plies extend at equal but the opposite angles with respect to the circumferential directions. In some instances where air entrapment is undesirable with high speed rotation of the drums in the roll being wound, a venting pattern may be employed in the surface 42, FIG. 3 such as a series of grooves which permit the escape of air from the nip which is formed between the drum and roll surface.

While the structure is shown as providing support rolls in a two drum winder, it will be understood that the principles of the invention may be employed with a single drum winder and on other forms of winders wherein a nip is formed between a drum and the roll being wound.

The resultant structure provides support drums which have a fixed circumference and which increase the area of contact as a frunction of the nip pressure. Various operating conditions can be obtained by the operator by increasing the air pressure in the drum, by controlling the force applied by the rider roll, and by controlling the lifting force applied to the roll being wound.

Thus, it will be seen that we have provided an improved drum and rider roll construction which meets the objectives and advantages above set forth and obtains an improved winder operation and long reliable operating life without disadvantages heretofore present in covered drums or steel winder drums.

We claim as our invention:

1. A winder for continuously winding a traveling web onto a roll comprising in combination:

first and second parallel horizontal drums defining a winding nest therebetween for supporting a rotating roll being wound;

at least one of said drums having a circumferential outer surface layer formed of an elastomeric material having substantially nonextensible cords embedded in the material with the circumference of the drum remaining constant throughout the axial length of the drum due to the nonextensibility of the cords;

said material deforming to provide surface area contact with the roll being wound and accomodating irregularities in the surface of the roll along the length thereof maintaining surface area contact along the length of the roll;

means for delivering a web to the roll; and means for rotating the roll to wind the web thereon.

2. A winder for continuously winding a traveling web onto a roll comprising in combination:

first and second parallel horizontal drums defining a winding nest therebetween for supporting a rotating roll being wound;

at least one of said drums having a circumferential outer surface layer formed of an elastomeric material having substantially nonextensible cords embedded in the material with the circumference of the drum remaining constant due to the nonextensibility of the cords;

said drum including an inflatable fluid chamber; the outer surface layer surrounding said inflatable fluid chamber to provide a resilient backing for the surface layer in its support of the roll;

said material deforming to provide surface area contact with the roll being wound and accomodating irregularities in the surface of the roll along the length thereof maintaining surface area contact along the length of the roll;

means for delivering a web to the roll; and means for rotating the roll to wind the web thereon.

3. A winder for continuously winding a traveling web onto a roll constructed in accordance with claim 2:

wherein said cords extend at an angle to the direction of surface rotation of the drum.

4. A winder for continuously winding a traveling web onto a roll constructed in accordance with claim 3:

wherein said angle is in the range of 0° to 25°.

5. A winder for continuously winding a traveling web onto a roll comprising in combination:

first and second parallel horizontal drums defining a winding nest therebetween for supporting a rotatable roll being wound;

at least one of said drums having an inflatable fluid chamber and a circumferential outer surface layer formed of an elastomeric material and surrounding the inflatable fluid chamber with the surface layer deforming to provide surface area contact with the roll being wound and accomodating irregularities along the length of the roll maintaining planar support over the length of the roll;

means for delivering a web to the roll; and means for rotating the roll supported on the drums.

6. A winder for continuously winding a traveling web onto a roll constructed in accordance with claim 5:

wherein the inflatable chamber is divided into a plurality of circumferential chambers axially arranged along the length of the drum.

7. A winder for continuously winding a traveling web onto a roll constructed in accordance with claim 5:

and including a rider roll engaging the roll being wound with a downward force to controllably affect the force of contact between the roll being wound and the drums.

8. A winder for continuously winding a traveling web onto a roll constructed in accordance with claim 5:

wherein the means for rotating the roll is in the form of a drive connected to drive at least of said drums.

9. A winder for continuously winding a traveling web onto a roll constructed in accordance with claim 5:

including means for controlling the pressure of the fluid in the chamber to control the width of the area of contact of the nip between the drum and roll being wound.

10. A winder for continuously winding a traveling web onto a roll constructed in accordance with claim 5:

wherein the surface layer of material is rubber.

11. A winder for continuously winding a traveling web onto a roll constructed in accordance with claim 6:

wherein each drum has a hollow cove and each of the individual chambers has an annular outer surface extending parallel to the drum axis and has radially extending annular side walls joining the core on the drum so as to provide an individual compartment with means for inflating said individual compartments.

12. A winder for continuously winding a traveling web onto a roll comprising in combination:

a winder roll in pressure contact with a roll being wound;

the winder roll having an annular outer surface layer of flexible material for contact with the roll being wound with the layer forming the outer wall of a fluid chamber supporting the surface layer and accomodating deformation of the layer with irregularities along the length of the wound roll with the layer flattening to provide area contact with the roll being wound;

the fluid chamber being comprised of a plurality of compartments along the length of the winder roll;

means for supplying a traveling web to the roll being wound;

and means for rotating the roll being wound.

13. A winder for continuously winding a traveling web onto a roll comprising in combination:

a winder roll in pressure contact with a roll being wound;

the winder roll having an annular outer surface layer of flexible material for contact with the roll being wound with the layer forming the outer wall of a fluid chamber supporting the surface layer and accomodating deformation of the layer with irregularities along the length of the wound roll with the layer flattening to provide area contact with the roll being wound;

the fluid chamber being selectively inflatable with air to a pressure to provide a predetermined flattening at a given weight of the roll being wound;

means for supplying a traveling web to the roll being wound;

and means for rotating the roll being wound.

14. A winder for continuously winding a traveling web onto a roll comprising in combination:

a winder roll in pressure contact with a roll being wound;

the winder roll having an annular outer surface layer of flexible material for contact with the roll being wound with the layer forming the outer wall of a fluid chamber supporting the surface layer and accomodating deformation of the layer with irregularities along the length of the wound roll with the layer flattening to provide area contact with the roll being wound;

annular extending nonextensible cords embedded in the outer layer along the entire axial length of the winder roll obtaining a fixed circumference for the winder roll;

means for supplying a traveling web to the roll being wound;

and means for rotating the roll being wound.

15. A winder for continuously winding a traveling web onto a roll constructed in accordance with claim 14:

wherein said winder roll is one of a pair of parallel horizontal drums providing an upwardly facing support nest for supporting a roll on the drums.

16. The method of winding a roll with a continually traveling web comprising in combination:

engaging the wound roll with at least one support roll constructed with an outer deformable layer surrounding an inflatable fluid chamber so that the support roll will deform to provide surface contact with the roll being wound;

and changing the inflation pressure within the support roll to obtain the desired flattening and the desired surface area of contact.

17. The method of winding a roll with a continually traveling web in accordance with the steps of claim 16:

wherein the roll being wound is supported on a pair of drums each formed with an outer layer in engagement with the roll being wound and the layer supported by an axially extending circumferential fluid chamber;

and controllably changing the inflation pressure within the drums to obtain the desired flattening of the drum surfaces and the desired surface area of contact with the roll being wound.

18. A winder for continuously winding a web of material onto a roll, said winder comprising a drum mounted in parallel relationship, and for engagement with, said roll, said drum having a deformable outer peripheral surface of constant circumferential length such that upon engagement with said roll said outer surface conforms to the contour of said roll without distortion of the circumferential length of said outer surface.

19. A winder as claimed in claim 18 wherein said outer peripheral surface includes a fluid inflatable toroidal chamber with the radially outer surface including a circumferentially inextensible reinforcing structure along the entire axial length of said drum.

20. A winder as claimed in claim 19 wherein said fluid inflatable toroidal chamber includes a plurality of chambers along the axial length of said drum.

21. A winder as claimed in claim 19 wherein said inextensible reinforcing structure comprises inextensible cords extending circumferentially of said peripheral surface.

22. A winder as claimed in claim 20 wherein said inextensible reinforcing structure comprises inextensible cords extending circumferentially of said peripheral surface.

23. A winder as claimed in claim 19 wherein said reinforcing structure comprises two layers of cord reinforcing material with the cords in the respective layers extending at equal but opposite angles of ten to 30 degrees with respect to circumferential directions.

24. A winder as claimed in claim 23 further characterized by a pair of said drums being arranged in parallel relationship with each other to form a nest for receiving said roll.

25. A winder as claimed in claim 22 further characterized by a pair of said drums being arranged in parallel relationship with each other to form a nest for receiving said roll.

* * * * *